US006796073B2

(12) United States Patent
Glock

(10) Patent No.: US 6,796,073 B2
(45) Date of Patent: Sep. 28, 2004

(54) METHOD FOR PRODUCING A BARREL MARKING

(76) Inventor: Gaston Glock, Klagenfurter Str. 32a, A-9220 Velden (AT)

( * ) Notice: Subject to any disclaimer, the term of this patent is extended or adjusted under 35 U.S.C. 154(b) by 0 days.

(21) Appl. No.: 10/340,011

(22) Filed: Jan. 10, 2003

(65) Prior Publication Data

US 2003/0143354 A1 Jul. 31, 2003

(30) Foreign Application Priority Data

Jan. 10, 2002 (AT) ..... 0035/02

(51) Int. Cl.[7] ..... F41A 21/00

(52) U.S. Cl. ..... 42/76.01; 42/90; 29/1.1; 29/1.11; 408/3

(58) Field of Search ..... 42/90, 106, 76.01, 42/78; 29/1.1, 1.11; 408/3

(56) References Cited

U.S. PATENT DOCUMENTS

| | | | | |
|---|---|---|---|---|
| 3,777,385 A | | 12/1973 | Hagan | |
| 4,035,942 A | | 7/1977 | Wiczer | |
| 4,175,346 A | | 11/1979 | Zemsky | |
| 4,411,569 A | * | 10/1983 | Pizzola | 409/261 |
| 4,690,737 A | | 9/1987 | Vishnitsky | |
| 4,936,608 A | | 6/1990 | Gensel et al. | |
| 5,004,529 A | | 4/1991 | Vishnitsky | |
| 5,758,446 A | * | 6/1998 | Atchison | 42/78 |
| 2001/0029690 A1 | | 10/2001 | Randall et al. | |

FOREIGN PATENT DOCUMENTS

| | | |
|---|---|---|
| AT | 402702 | 8/1997 |
| DE | 3045443 | 6/1981 |
| DE | 3728622 | 5/1988 |
| EP | 0438871 | 7/1991 |
| FR | 2 683 064 A | 4/1993 |

OTHER PUBLICATIONS

European Search Report for corresponding application EP 02 45 0271.

* cited by examiner

*Primary Examiner*—J. Woodrow Eldred
(74) *Attorney, Agent, or Firm*—Kilpatrick Stockton LLP

(57) ABSTRACT

The invention pertains to a method for producing a barrel marking on the inner side (4) of the barrel (2) of a firearm. Barrel markings on firearms are used for marking projectiles fired from the respective firearm and to thusly allow a largely definitive allocation of a projectile to the weapon from which it was fired.

Figure 1:
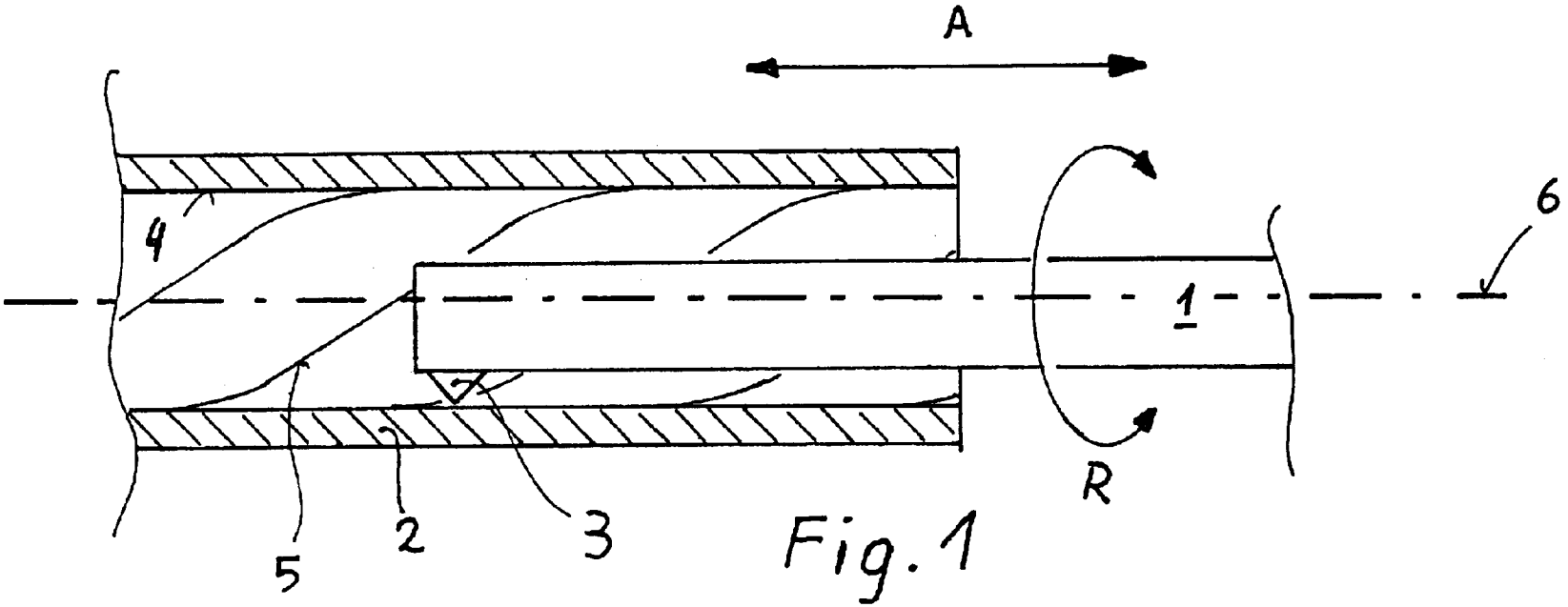

The invention is characterized by the fact that at least one groove which follows the rifling (5) of the barrel is mechanically produced in the barrel wall by means of a finger-like tool (1) that can be displaced relative to the longitudinal axis (6) of the barrel and turned about the longitudinal axis of the barrel, namely after the inner side of the barrel (2) is finished, preferably during the manufacture of the barrel.

The invention also pertains to thusly manufactured barrels and to a device for carrying out said method.

7 Claims, 1 Drawing Sheet

METHOD FOR PRODUCING A BARREL MARKING

DESCRIPTION

The invention pertains to a method for producing a barrel marking on the inner side of the barrel of a firearm, as well as to thusly marked barrels. Barrel markings on firearms are used for marking projectiles fired from the respective firearm and to thusly allow a largely definite allocation of a projectile to the weapon from which it was fired. Various methods for producing such markings are known. The invention also pertains to barrels manufactured in accordance with this method, as well as to a device for carrying out this method.

A method in which the markings are produced by means of a finger-like tool that is inserted into the barrel and the movements of which follow the rifling of the barrel is known from US 2001/0029690 A1, the disclosure of which is incorporated into the present application by reference. In this case, a thin photoresist film is applied onto the inner wall of the barrel, with the marking subsequently being produced at the intended locations by means of an exposure process. Leaving aside the numerous production steps and the drying times to be observed in between these steps, etc., each individual step of this method is complicated, e.g., the strip-shaped exposure in the interior of the barrel.

A method for producing a barrel marking is also known from AT 402 702 B by the applicant. In this case, a statistical pattern that correspondingly marks the projectile is produced in the muzzle region of the barrel by means of spark erosion. The disclosure of this publication is incorporated into the present application by reference.

A different barrel marking in the form of marking grooves is known from U.S. Pat. No. 4,175,346 A, the disclosure of which is incorporated into the present application by reference. The barrel marking is only described in a very abstract form in this publication, with the main focus pertaining to the combination of different widths and different arrangements of the marking grooves in the barrel. It is only described very summarily how this complex marking can be produced. Possible methods mentioned in this publication are:

1. Cold forming over a core;
2. Embossing or punching, wherein not even a brief explanation of this method is provided;
3. Electrolytic material removal by covering certain regions of the inner wall of the barrel and carrying out a subsequent anodic erosion of the uncovered surfaces; and
4. Firing a projectile that carries corresponding projections and thusly produces the markings while it passes through the barrel.

None of the above-mentioned methods is suitable for practical applications because either the dimensional accuracy of the barrel is negatively influenced (in the two first-mentioned methods) or the costs (for carrying out the two latter-mentioned methods) are enormous.

The publications listed below are not quite as closely related to the invention as the aforementioned state of the art: DE 30 45 443 C; DE 37 28 622 C; U.S. Pat. No. 3,777,385 A; U.S. Pat. No. 4,035,942 A; U.S. Pat. No. 4,690,737 A; U.S. Pat. No. 4,936,608 A; U.S. Pat. No. 5,004,529 A and EP 0 438 870 A. These publications pertain to etching processes, electrochemical machining processes, barrels consisting of several sections, the production of markings by means of lasers, the utilization of one or more marking rings in the barrel, the general utilization of lasers and spark erosion methods for producing the markings, etc. None of the disclosed solutions allows an economical production of barrel markings which is also technically feasible. The disclosure of all these publications is incorporated into the present application by reference.

Based on the aforementioned state of the art, the invention aims to disclose a method that makes it possible to easily produce barrel markings, namely not only stochastic markings as proposed in AT 402 702 B, but also markings that correspond to a code or a scheme as disclosed in U.S. Pat. No. 4,175,346 A or US 2001/0029690 A1, and thus, if desired, to make it possible to realize a simple and definitive allocation of a projectile to a barrel or a group of barrels.

The invention proposes that at least one groove which follows the rifling of the barrel be produced in the barrel wall during the manufacture of the barrel by means of a finger-like tool that can be displaced relative to the longitudinal axis of the barrel and turned about the longitudinal axis of the barrel.

In this case, the tool mechanically produces the groove in the inner wall of the barrel material, for example, by means of a diamond tip, a hard metal tip or the like, or by means of a hard metal wheel or the like.

In the description and in the claims, the term "following the rifling of the barrel" refers to the fact that the marking in rifled firearms has the same axial pitch as said rifling. In smooth barrels, the marking extends linearly along a generatrix, i.e., the marking practically follows a zero-rifling.

The method according to the invention is equally suitable for weapons with a smooth barrel and weapons with individual riflings. In addition, the invention may also be utilized in so-called barrels with hexagonal cross section or another barrel design.

Before the invention is described below with reference to the figures, one typical method for manufacturing the barrel of a pistol is briefly discussed. Naturally, the method according to the invention may also be used for the barrels of all other types of firearms as long as they contain a barrel, as well as for all types of barrels, e.g., smooth barrels, rifled barrels, etc. The cores are usually drilled out of cylindrical blanks, with the final dimensions of the inner barrel wall subsequently being realized by means of cold forging, drawing or electrolytic methods, and with, if applicable, the riflings or a polygonal shape subsequently being produced. The corresponding outside shape is then realized at the location of the subsequent breech by means of mechanical processing, wherein a correlation between the position of the riflings and the circumferential orientation usually no longer exists due to the required change of processing machines.

According to the invention, a simple tool of finger-shaped design is inserted into the barrel by at least a short section from the muzzle side after the inner barrel surface is manufactured and before material is removed from the outside of the workpiece, wherein the corresponding groove on the inner barrel wall is produced while said tool is inserted into or pulled out of the barrel. Since the processing machine for producing rifled barrels requires a device for simultaneously turning and axially displacing a tool, it is very simple to always move the finger-like tool along a path that correspond to the rifling. Any type of code can be produced on the inner walls of the barrel by correspondingly arranging the grooves within predetermined circumferential distances. This is realized by correspondingly turning the barrel or the tool between the production of two grooves. Codes of this type are sufficiently known from the aforementioned state of the art and consequently not explained in detail.

The code does not have to extend over the entire length of the barrel. It is advantageous to realize the code in the muzzle region so as to prevent the marking of the projectile from becoming weakened or even rendered unrecognizable by an ensuing unmarked barrel section.

Figure 2:
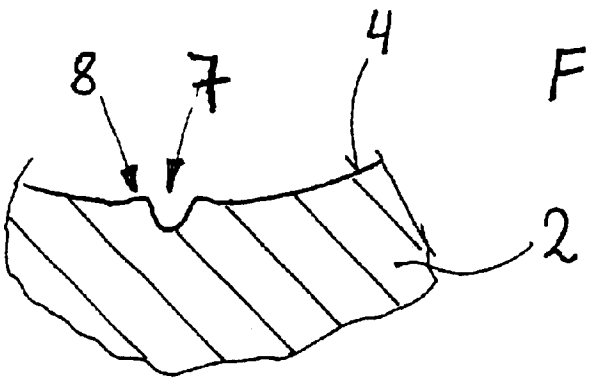

The invention is illustrated in detail in the figures. The figures show:

FIG. 1, a purely schematic longitudinal section through a barrel, into which a tool according to the invention is inserted, wherein a processing tip is arranged on the free end of said tool, and FIG. 2, an enlarged schematic section perpendicular to the barrel axis.

FIG. 1 shows that a finger-like tool 1 is inserted into the interior of a barrel 2 in the axial direction (double arrow A), namely without a processing tip 3 arranged on the tool 1 contacting the inner wall 4 of the barrel 2. Once the axial position at which the marking should begin is reached, the tool 1 is moved in the radial direction until its processing tip 3 comes in contact with the inner wall 4 and adjoins this inner wall with a predetermined processing force.

The finger-like tool 1 is then pulled out of the barrel in the axial direction A, wherein the tool 1 simultaneously carries out a rotational movement R relative to the barrel 2. In this case, the correlation between these two movements corresponds to that during the previous manufacture of the (schematically shown) rifles 5. Due to these measures, a groove is produced in the inner surface 4 of the barrel 2 which has the same axial pitch as the rifles 5 and provides each projectile fired through the barrel with a special marking.

It is possible to produce the grooves while the tool 1 is moved into the barrel (wherein the tool is subjected to pressure). Alternatively, one groove can be produced while the tool is moved into the barrel and the next groove can be produced while the finger-like tool 1 is moved out of the barrel. In this respect, the term "into the barrel" refers to the tool being subjected to pressure (during the marking process) and the term "out of the barrel" refers to the tool being subjected to tension (while the marking is produced), wherein bending forces are respectively neglected.

It is possible to provide each projectile with a completely unique, characteristic "fingerprint" by combining grooves that are arranged at predetermined circumferential locations and the positions of which relative to one another do not change, but merely follow the rifles 5 about the axis 6 of the barrel 2.

FIG. 2 shows an enlarged, purely schematic section through a groove 7 produced in accordance with the invention, wherein said section extends perpendicular to the barrel axis 6. The shape and arrangement of the grooves 7 depends on the respective processing tip 3 used and the production method. When utilizing a spark erosion method, essentially rounded grooves are produced. In the (shown) instance, in which diamond tips, hard metal tips or hard metal wheels (scraping or compressive processing) are used, depressions that correspond to the shape of the tool are produced, however, with edges 8 that slightly protrude radially inward over the undisturbed surface 4 because the material of the groove 7 is partially or entirely "displaced." In this case, a strain-hardening in this image region also occurs such that the service life of the barrel is favorably influenced.

The invention is not limited to the described and illustrated embodiment. For example, it is possible to produce grooves 7 of different widths and/or depths, or to provide only one single groove. It would also be conceivable for the tool 1 to simultaneously produce more than one groove 7, in particular, when marking barrels with a larger diameter. In this context, it would also be conceivable to provide artillery weapons with such markings, for example, in order to better monitor weapons embargoes.

It is also possible to provide the finger-like tool 1 with a counter-support in the region of the processing tip 3, wherein said counter-support is braced on the side of the inner wall 4 of the barrel 2 which is situated opposite the processing tip 3. This makes it possible to essentially eliminate or at least significantly reduce bending stresses on the shaft of the finger-like tool 1. In this case, the only important aspect is that the counter-support does not damage the barrel. This can be easily realized by utilizing a plastic roll with a bomb-shaped running surface. In this case, the entire tool 1 is not radially adjusted, but the processing tip and the counter-support are spread apart, for example, due to a displacement along wedge surfaces, the opening of a scissor-type mechanism or the like.

What is claimed is:

1. Method for producing a barrel marking on the inner side (4) of the barrel of a firearm, wherein at least one marking having the same axial pitch as the rifling (5) of the barrel is produced in the barrel wall by means of a an elongate tool (1) that can be displaced radially relative to the longitudinal axis (6) of the barrel and turned about the longitudinal axis of the barrel, characterized by the fact that the marking is produced by means of mechanical processing either after the barrel is finished, or during the manufacture of the barrel.

2. Method according to claim 1, characterized by the fact that the mechanical processing consists of compressive processing.

3. Method according to claim 1, characterized by the fact that the mechanical processing consists of scratch processing.

4. Device for producing a groove (7) in a barrel (2) with an elongate tool (1) that carries a processing tip (3), wherein the elongate tool (1) can be displaced along and turned about the axis (6) of the barrel (2), characterized by the fact that the processing tip (3) is also movable in the radial direction referred to the longitudinal axis of the elongate tool and wherein the processing tip comprises an operative portion selected from a diamond wheel, a hard metal wheel, a diamond tip or a hard metal tip.

5. Device according to claim 4, characterized by the fact that the finger-like tool (1) carries a counter-support on its side that faces away from the processing tip (3), and by the fact that the radial distance between the processing tip (3) and the counter-support is variable.

6. Barrel manufactured by means of the method according to claim 1, characterized by the fact that the marking consists of at least one groove (7), the edges (8) of which protrude radially inward over the inner side (4) of the barrel (2).

7. Barrel according to claim 6, characterized by the fact that the edges (8) of the groove (7) are strain-hardened.

* * * * *